US006539670B2

(12) United States Patent
Haag et al.

(10) Patent No.: US 6,539,670 B2
(45) Date of Patent: Apr. 1, 2003

(54) MANUAL RELEASE MECHANISM FOR A POWER OPERATED SLIDING DOOR

(75) Inventors: Ronald Helmut Haag, Clarkston, MI (US); Lloyd Walker Rogers, Jr., Shelby Township, MI (US); Ronald James Wilde, St. Clair Shores, MI (US); Thomas Ralph Osborn, Dearborn Heights, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/898,228

(22) Filed: Jul. 3, 2001

(65) Prior Publication Data

US 2003/0005635 A1 Jan. 9, 2003

(51) Int. Cl.[7] ..... E05B 65/10

(52) U.S. Cl. ..... 49/141; 49/139; 49/140; 49/360

(58) Field of Search ..... 49/139, 140, 360, 49/352, 199, 200, 201, 141; 296/155; 16/86 A, 86 R; 403/291, 292, 321; 160/188, 201; 74/625

(56) References Cited

U.S. PATENT DOCUMENTS 3,235,246 A * 2/1966 Cowan
3,630,094 A * 12/1971 Carli et al. ..... 74/89.21
3,722,141 A * 3/1973 Miller ..... 49/139
4,597,428 A * 7/1986 Iha ..... 160/188
4,640,050 A * 2/1987 Yamagishi et al. ..... 49/280
4,905,542 A * 3/1990 Burm et al. ..... 74/625
5,010,688 A * 4/1991 Dombrowski et al. ..... 49/362
5,063,710 A * 11/1991 Schap ..... 49/280
5,253,451 A * 10/1993 Hormann ..... 49/139
5,316,365 A 5/1994 Kuhlman et al.
5,787,636 A * 8/1998 Buchanan, Jr. ..... 49/360
6,050,028 A * 4/2000 Nishimura et al. ..... 49/280
6,226,925 B1 * 5/2001 Shimura et al. ..... 49/360
6,273,174 B1 * 8/2001 Singleton ..... 160/201
6,464,287 B2 * 10/2002 Rogers, Jr. et al. ..... 296/155
2001/0022049 A1 * 9/2001 Clark et al. ..... 49/360

* cited by examiner

*Primary Examiner*—Gregory J. Strimbu
(74) *Attorney, Agent, or Firm*—Kathryn A. Marra

(57) ABSTRACT

A manual release mechanism of a power actuated sliding door used typically for van applications, includes a bullet assembly interconnected between the ends of a pull member, or cable, of a powered pulley system. The bullet assembly engages and disengages within a passage of a hinge roller assembly which rides within a track of the vehicle. When disengaged, the door is free to slide without causing movement of the bullet assembly or powered pulley system. When engaged, the hinge roller assembly supports a pin which projects into the passage when in a rest position. If the bullet assembly is in the passage, the pin also projects into a groove of the bullet assembly, thereby, locking the bullet assembly within the passage and causing the hinge rolling assembly, which is pivotally connected to the door to move via operation of the powered pulley system. Disengagement of the pin or retraction of the passage way via a manual release handle causes the hinge roller assembly to disengage from the bullet assembly and therefore from the powered pulley system allowing for manual operation of the door independent of the pulley system.

14 Claims, 7 Drawing Sheets

MANUAL RELEASE MECHANISM FOR A POWER OPERATED SLIDING DOOR

FIELD OF THE INVENTION

This invention relates to a sliding vehicle door and more particularly to a manual release mechanism for a power operated sliding vehicle door.

BACKGROUND OF THE INVENTION

U.S. Pat. No. 5,316,365 granted to Howard W. Kuhlman et ux May 31, 1994 discloses a van that has a sliding door that is power operated by a direct current electric motor. The Kuhlman '365 patent is herein incorporated by reference. As shown in FIG. 9 of the Kuhlman '365 patent and herein disclosed as FIG. 12, the direct current motor drives front and rear cable drive pulleys (A), (B) which simultaneously reel and unreel front and rear cables (C), (D) that are attached to a hinge and roller assembly (E). The hinge and roller assembly (E) is attached pivotally to the rear portion of the sliding door (not shown) and travels in a center track (F) that is located in the rear quarter body panel of the van behind the opening for the sliding door. Center track (F) has a curved forward end (G) that guides the hinge and roller assembly (E) so that the rear portion of the sliding door is moved horizontally inwardly toward the side of the van in the closed position. The power mechanism incorporates a clutch which permits manual operation of the door without engaging the motor. When operating manually, the gear train, cables and pulleys must rotate or move as if the electric motor were actuated. Due to the high gear ratio of the gear drive, from the electric motor to the cable drive pulleys, the sliding door is difficult to move in the manual mode.

SUMMARY OF THE INVENTION

This invention provides a manual release mechanism so that a sliding door normally operated by a powered pulley system can be manually opened and closed easily. Preferably, manual operation of the sliding door is the same as if the powered pulley system did not exist. A hinge roller assembly, pivotally engaged between a track of a vehicle and a sliding door, has a passage which longitudinally extends along the track. A powered pulley system has a forward and rearward cable interconnected by a bullet assembly. The bullet assembly moves along the track with the forward and rearward cables when the powered pulley system is energized. When moving, the bullet assembly is either engaged within the passage, thereby moving the door, or is moving into the passage to re-engage with the hinge roller assembly and thereby the door.

Mounted on the hinge roller assembly is a spring loaded pin which projects into the passage when the pin is in a rest position. An operator attached to the pin is capable of retracting the pin from the passage. When retracted, the hinge roller assembly is disengaged from the bullet assembly and the door is capable of manual operation without incurring movement or resistance from the powered pulley system.

With the pin in the rest position, and the bullet assembly disposed outside of the passage, the bullet assembly must first move into the passage and engage the pin, before the powered pulley system can move the door. To do this, the bullet assembly has a forward and a rearward portion having respective forward and rearward noses oriented back-to-back. A space, or preferably a groove, is defined between the forward and rearward portions so that the projecting pin can ride against the nose, moving radially outward, as the bullet assembly enters the passage and until the pin snaps into the groove. With the pin in the groove, the bullet assembly is locked to the hinge roller assembly.

A feature of the present invention is the ability to completely disengage or divorce a power system of a sliding door from the door permitting easy manual operation of the door.

BRIEF DESCRIPTION OF THE DRAWINGS

These and other objects, features and advantages of this invention will be apparent from the following detailed description, appended claims, and accompanying drawings in which:

DETAILED DESCRIPTION OF PREFERRED EMBODIMENT

Figure 1:
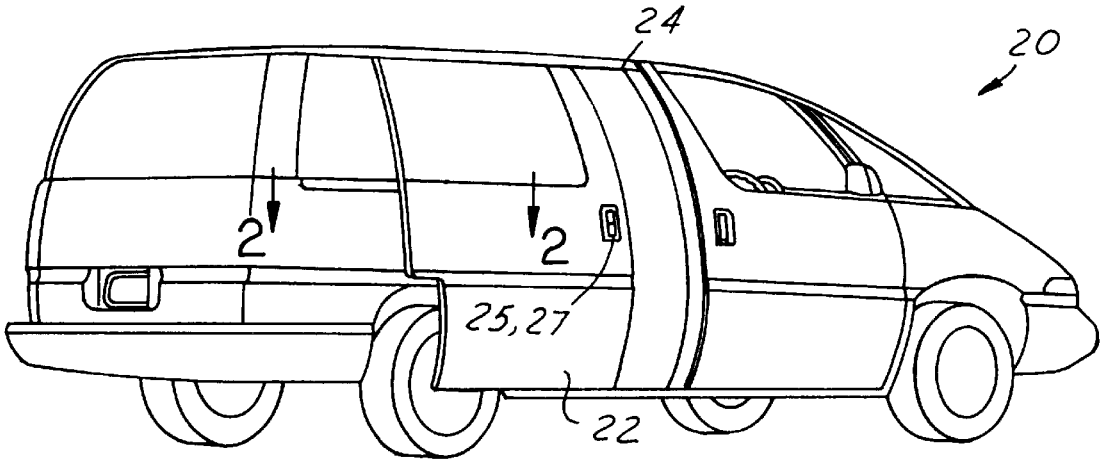
FIG. 1 is a perspective view of a van having a power operated sliding door.
Figure 2:
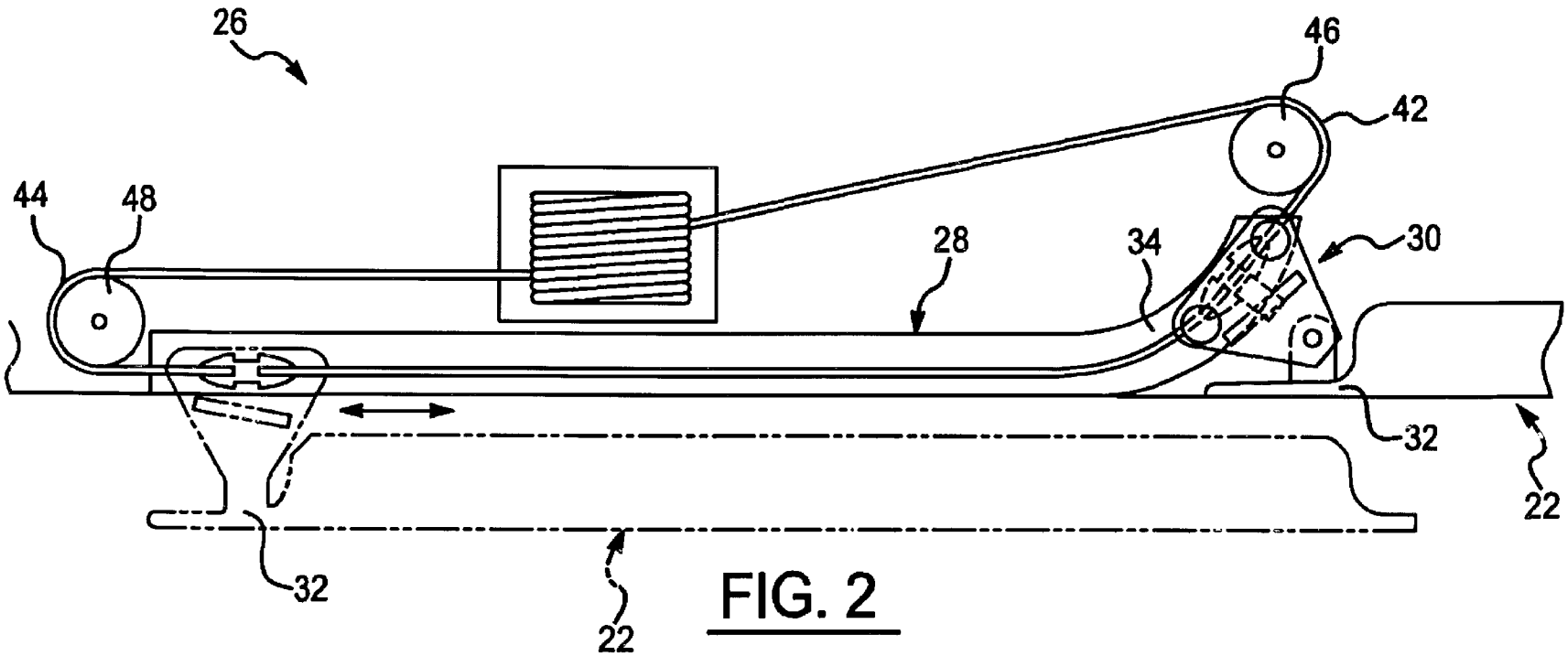
FIG. 2 is a top perspective view of a pulley system for the sliding door shown in a closed position, the door having a manual release mechanism of the present invention shown in an engaged position.

Referring to FIGS. 1 and 2 of the present invention, a vehicle or van 20 has a sliding door 22 which moves in a substantially horizontal direction closing and opening upon an opening 24. Actuation or pivoting of a standard spring-loaded door lever 25 to open or close the sliding door 22 will cause an electrically powered pulley system 26 to actuate and automatically open or close the door 22, accordingly, and provided a manual release handle 27 is in a normal or power position. The manual release handle 27 may be an integral part of the door lever 25 and is preferably accessible from either the inside or outside of the van 20. In case of a, power failure, simply moving the manual release handle 27 to a manual position, will permit opening and closing of the door 22 from the standard door lever 25 without causing the powered pulley system 26 to actuate or even move with the door 22. In-other-words, the door 22 is slid horizontally open or closed via the strength of the passenger. Typically, pulling the door 22 by the lever 25 in a rearward direction opens the door 22, and pushing the door 22 in a forward direction closes the door 22 upon the opening 24.

The powered pulley system 26 is substantially disposed horizontally and rearward of the opening 24. The door 22 rides along a horizontal rail 28 which bends inward at a curved forward end 34 so that the door 22 will not only travel in the forward and rearward directions, but will move laterally toward or away from the opening 24 of the van 22 just before closing or opening upon the opening 24. A hinge roller assembly 30 engages pivotally between the rail 28 and a rear portion 32 of the door 22. This pivoting connection permits the lateral movement of the door 22 upon the opening 24 as the hinge roller assembly 30 rides within the curved forward end 34 of the rail 28.

Figure 3:
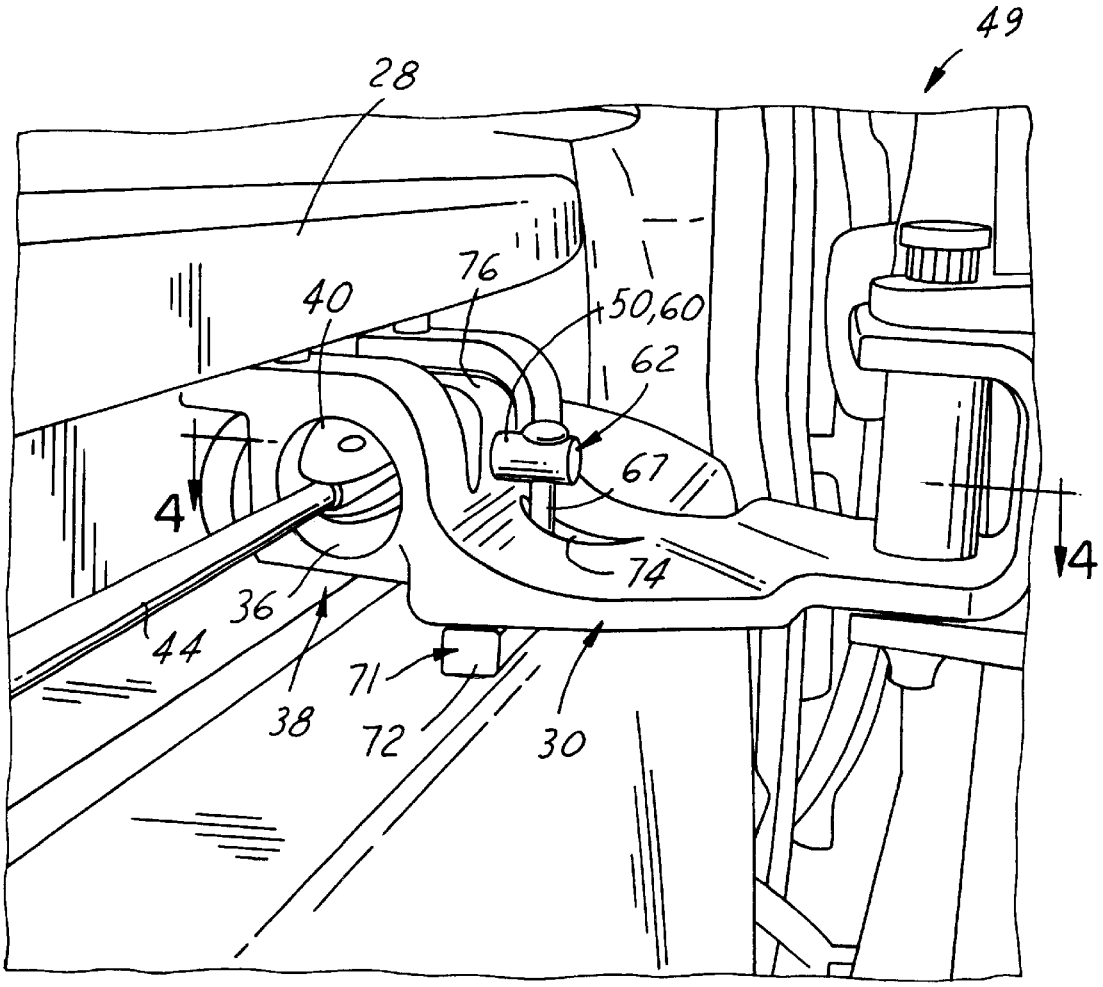
FIG. 3 is a rear perspective view of the manual release mechanism shown in the engaged position.

Referring to FIGS. 2 and 3, the hinge roller assembly 30 has a substantially horizontal elongated passage 36 having a centerline disposed parallel to the track 28 and orthogonal to the pivoting axis of the hinge roller assembly 30. When the powered pulley system 26 is in the power engaged position, as best shown in FIG. 3, an elongated bullet assembly 40 is disposed concentrically within the passage 36 and engaged to the hinge roller assembly 30. Because the bullet assembly 40 interconnects an elongated flexible forward pull member 42 with an elongated flexible rearward pull member 44 of the pulley system 26, pulling of the forward pull member 42 about a forward cable pulley 46, powered by an electric motor (not shown), will cause the bullet assembly 40 and thereby the door 22 to move forward within the rail 28 closing the door 22 upon the opening 24. Likewise, pulling of the rearward pull member 44 about a rear cable pulley 48, by preferably the same motor, will open the sliding door 22. The forward and rearward pull members 42, 44 may take the form of a cable, a chain a band, a strap, or any other type of elongated member which is flexible and capable of riding within the track or rail 28 and about the pulleys 46, 48. If the forward and rearward pull members 42, 44 comprise bands, the sides of each of the bands are disposed perpendicular to the planar face 100 of a first part 96 of the bullet assembly 40 and an opposing planar face 102 of the second part 98 of the bullet assembly 40.

The bullet assembly 40, the hinge roller assembly 30, and the manual release handle 27 generally comprise a manual release mechanism 49.

Figure 4:
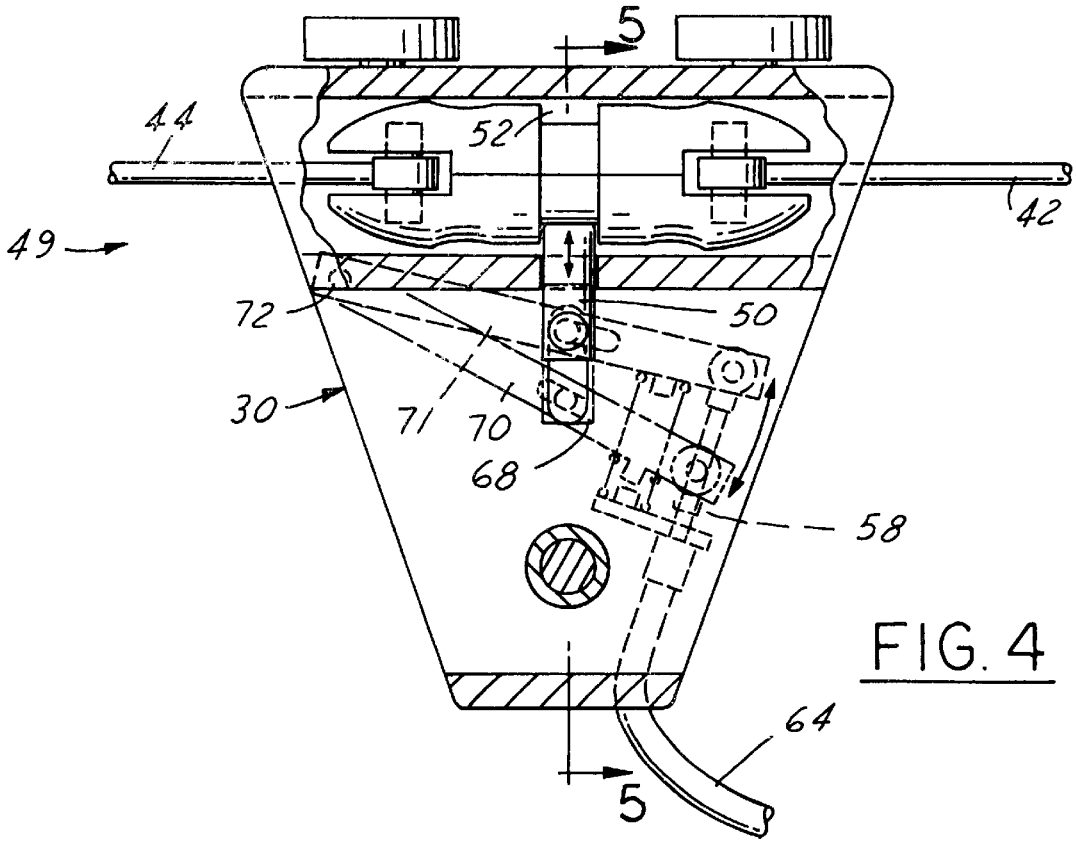
FIG. 4 is a cross section view of the manual release mechanism taken substantially along line 4—4 of FIG. 3 looking in the direction of the arrows.
Figure 5:
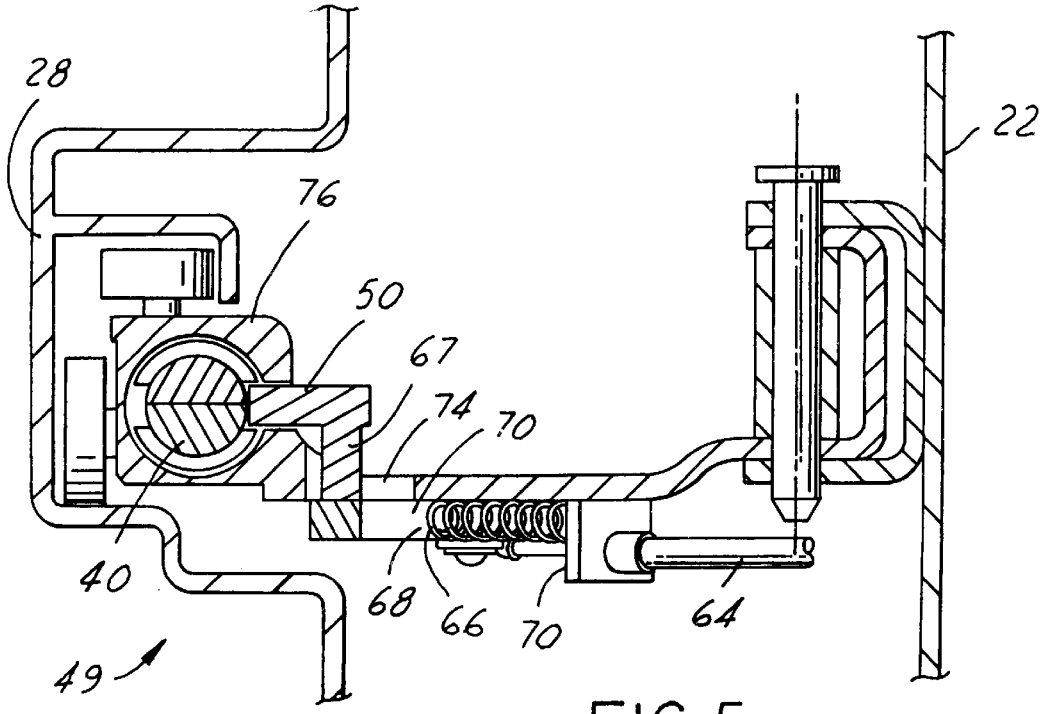
FIG. 5 is a cross section view of the manual release mechanism taken substantially along line 5—5 of FIG. 4 looking in the direction of the arrows.

As shown in FIGS. 3–5, the bullet assembly 40 is engaged or locked to the hinge roller assembly 30 by a spring loaded pin 50 which projects into a space 52 defined by or in the bullet assembly 40. Consequently, when either the forward or rearward pull members 42, 44 are pulled, the engaged bullet assembly 40 takes the hinge roller assembly 30 with it, along with the pivotally engaged door 22. Preferably, the space 52 is a groove which extends circumferentially about the mid section of the bullet assembly 40. Therefore any rotation of the bullet assembly 40 about its longitudinal axis will not misalign the pin 50 with the space or groove 52 which would prevent movement of pin 50 from a disengaged position 58 to an engaged or rest position 60 within the groove.

Figure 6:
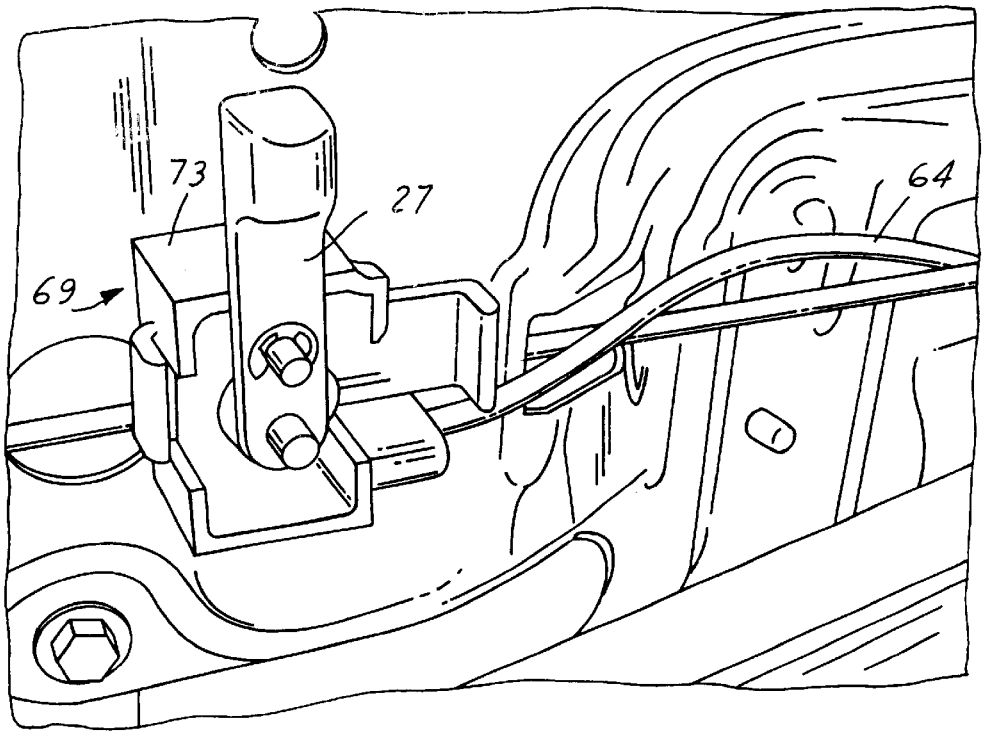
FIG. 6 is a perspective view of a manual release lever.
Figure 7:
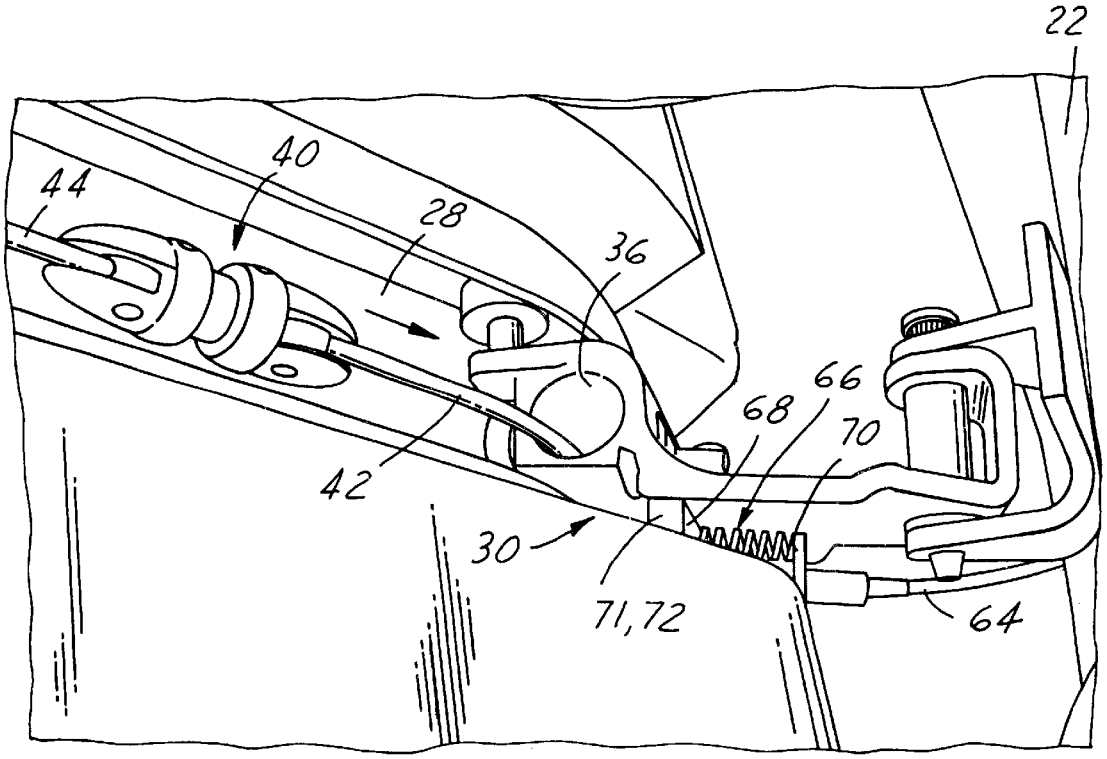
FIG. 7 is a perspective view of the manual release mechanism shown in a disengaged position.
Figure 8:
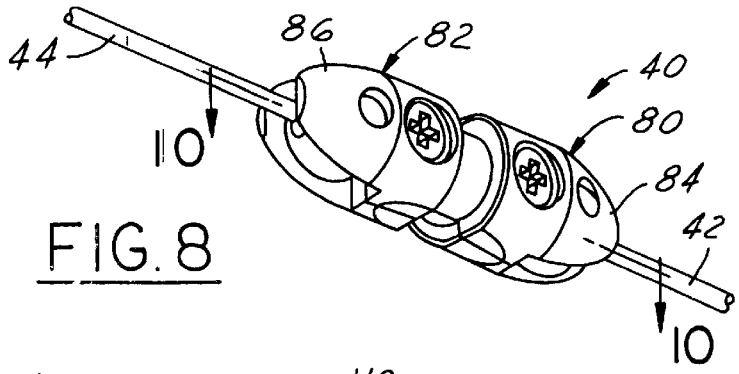
FIG. 8 is a perspective view of a bullet assembly.
Figure 9:
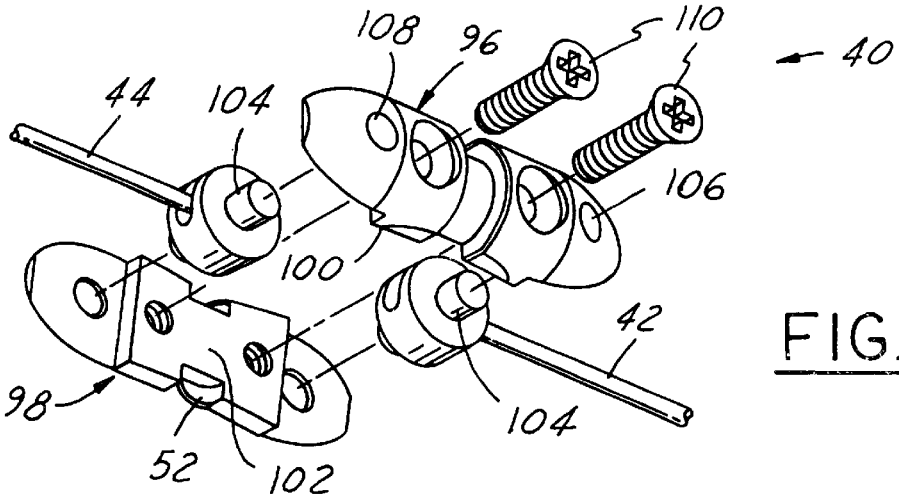
FIG. 9 is an exploded view of the bullet assembly.
Figure 10:
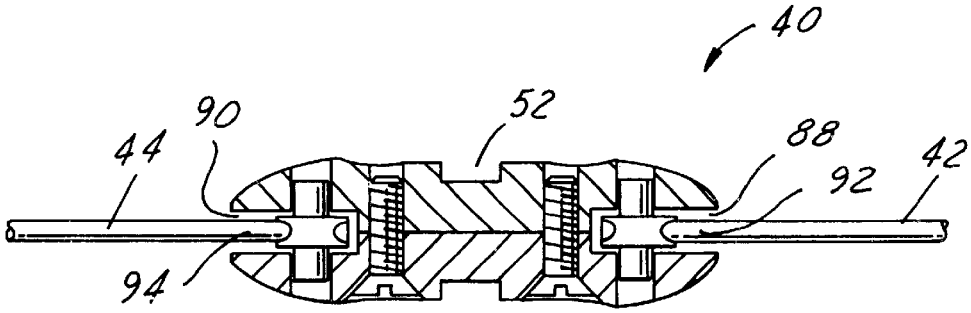
FIG. 10 is a cross section of the bullet assembly taken substantially along line 10—10 of FIG. 8 looking in the direction of the arrows.

The spring loaded pin 50 moves between the rest position 60 and the disengaged position 58 by way of the pin engagement device 62 which includes the manual release handle 27, as best shown in FIGS. 4–6. Device 62 has a push pull cable 64 engaged between the manual release handle 27 and the pin 50, thereby operating to move the pin 50 between the rest position 60 and the disengaged position 58. A spring 66 is disposed between a moving surface 68 engaged or formed to a vertical end of the pin 50 or vertical member 67 rigidly connected to the pin 50, and a stationary surface 70 defined by or projecting out of the hinge roller assembly 30. The pin 50 is generally engaged rigidly to a vertical member 67 which is engaged orthogonally to a pivot arm 71 at the distal end 68 of the pivot arm 71. Arm 71 is engaged pivotally to the hinge roller assembly 30 at an opposite pivot end 72. Preferably, the pivot arm 71 is mounted below the hinge roller assembly 30 and the member 67 projects upward through an elongated hole 74 of the hinge roller assembly 30 wherein the pin 50 projects through a wall portion 76 of the roller assembly 30 into the passage 36.

Because the push-pull cable 64 is interconnected to the manual release handle 27, moving the handle 27 from its normal or power position to its manual position, causes the cable 64 to pull upon the distal end 68 of the pivot arm 71. The moving surface 68 defined by or near the distal end 68 of the pivot arm 71 is thereby moved toward the stationary surface 70 compressing the spring 66. Pivoting the manual release handle 27 from the manual position to the power position will push upon cable 64 causing the spring 66 and pin 50 to return to its extended or rest position 68, wherein the pin 50 projects into the passage 36.

When the pin engagement device 62 is in the disengaged position 58, the hinge roller assembly 30 is free to move along the track 28 without having to carry the bullet assembly 40. Therefore, the forward and rearward pull members 42, 44, the related pulleys 46, 48, motors, and gears remain stationary and do not contribute toward frictional or movement resistance of the sliding door 22.

The powered pulley system 26 is coupled with a memory and tracking device 69 (substantially not shown) which indexes the last known position of the bullet assembly 40 within the rail 28 and monitors the manual movement of the sliding door 22 as best shown in FIG. 6. The memory and tracking device 69 has an electric switch 73 attached operatively to the handle 27. When the manual release handle 27 is moved from the manual position to the power position, the electrical switch opens sending a high signal to a controller which enables actuation of the powered pulley system 26. With system 26 enabled, movement of the door lever 25 by an operator will energize the powered pulley system 26, moving the bullet assembly 40 toward the hinge roller assembly 30 until it reinserts itself within the passage 36. When the manual release handle 27 is moved to the manual position, the electric switch 73 closes, sending a low signal to the controller which indexes the location of the bullet assembly 40 and disables the powered pulley system 26.

When handle 27 is returned to the power position, the pin 50 is reinserted into the passage 36. Moreover, when the lever 25 is then moved, the powered pulley system 26 actuates moving the bullet assembly 40 back into the passage 36. As the bullet assembly 40 moves into the passage 36, the projecting pin 50 rides radially outward against a forward nose 84 of a forward bullet portion 80, or rearward nose 86 of a rearward bullet portion 82, depending on direction of travel, until the pin 50 snaps into the groove 52 of the bullet assembly 40, locking the bullet assembly 40 to the hinge roller assembly 30.

The portions 80, 82 are disposed back to back and the respective forward nose 84 and rearward nose 86 project opposingly from one another. Because of the conical shape of the noses 84, 86 the pin 50 rides radially outward upon either nose 84, 86 against the resilience of the spring 66 until the pin 50 snaps into the groove 52 which is disposed substantially or generally between the forward and rearward bullet portions 80, 82. The curvature of the forward and rearward noses 84, 86 also assures that the bullet assembly 40 can freely enter or exist the passage 36 even when the hinge roller assembly 30 is disposed at the curved forward end 34 of the rail 28.

Referring to FIGS. 8–11, laterally bisecting the forward and rearward noses 84, 86 are respective forward and rearward slots 88, 90. A forward pull end 92 of the forward pull member 42 is pivotally engaged to the forward nose 84 within the forward slot 88. Likewise, a rearward pull end 94 of the rearward pull member 44 is pivotally engaged to the rearward nose 86 within the rearward slot 90. The pivot axes of both the forward and rearward pull ends 92, 94 are transverse, and preferably perpendicular to their respective slots 88, 90.

The bullet assembly 40 is bisected or divided longitudinally forming a longitudinal first part 96 and a longitudinal second part 98. The first part 98 has a planar face 100 which engages an opposing planar face 102 of the second part 98. The faces 100, 102 substantially lie within the same imaginary plane as the center plane of the forward slot 98 and the rearward slot 90. During assembly of the bullet assembly 40, a traverse member 104 of each pull end 92, 94 inserts into respective forward and rearward bores 106, 108 which laterally penetrate the respective forward and rearward noses 84, 86. The first and second parts 96, 98 are held together by a pair of fasteners or threaded bolts 110 which laterally thread into the second part 98 through the first part 96 on either side of the groove 52.

Figure 11:
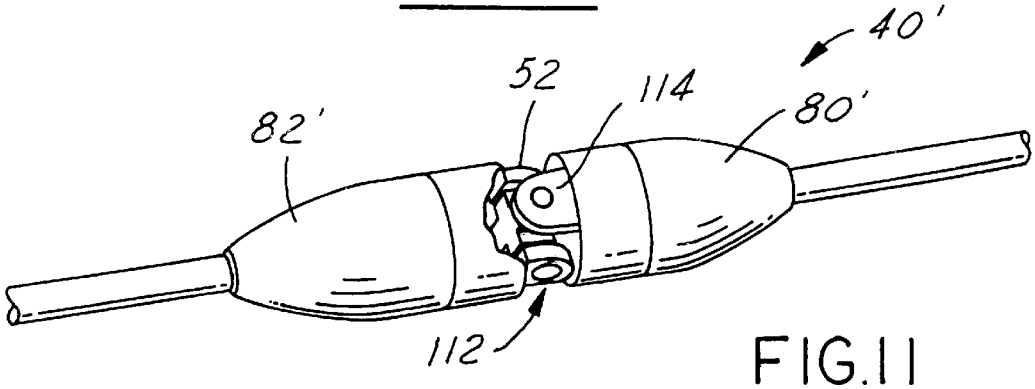
FIG. 11 is a perspective view of a second embodiment of the bullet assembly.
Figure 12:
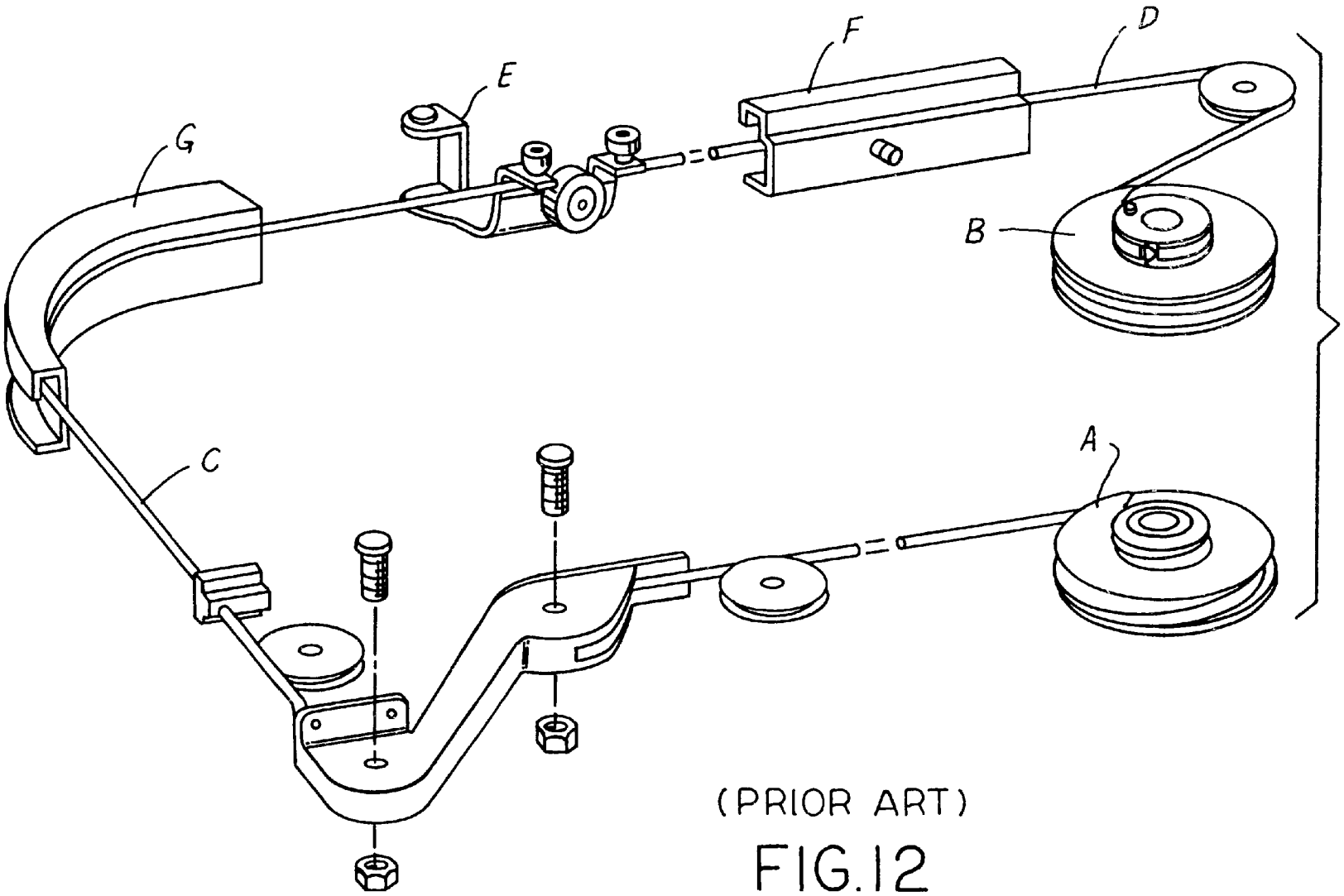
(PRIOR ART) FIG. 12
FIG. 12 is a perspective view of a prior art powered pulley system for a sliding door.
Figure 13:
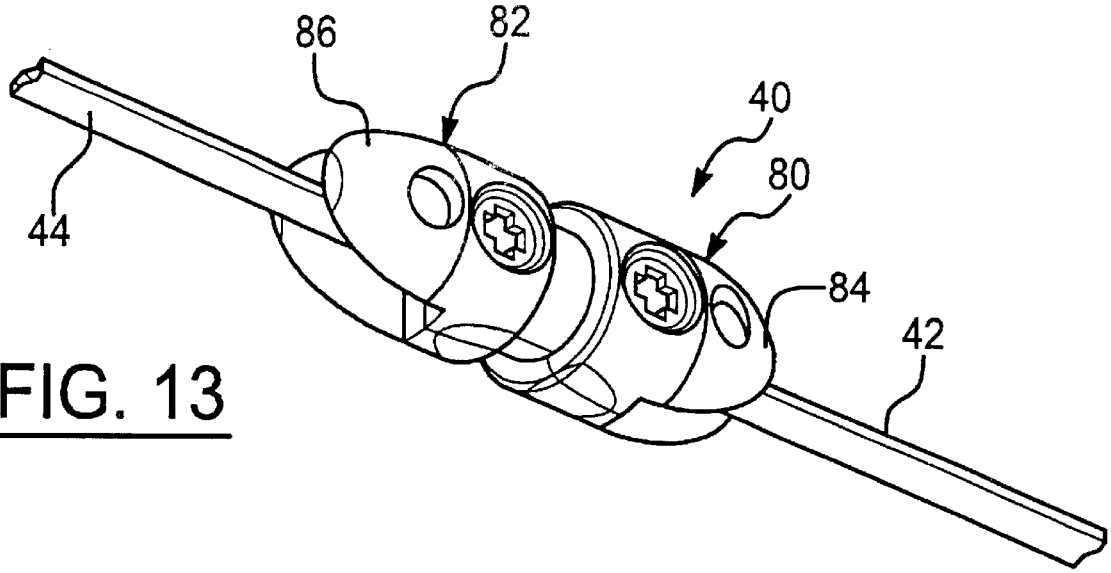
FIG. 13 is a perspective view of a bullet assembly having pull member bands.

Referring to FIG. 11, a second embodiment of the bullet assembly 40' is shown, wherein the elongated first and second parts 96, 98 and slots 88, 90 of the first embodiment are replaced with a universal joint 112. Joint 112 interconnects the forward bullet portion 80' with the rearward bullet portion 82' and is preferably a Cardan type universal joint having two yokes and a cross piece. In this case, the yokes are formed integrally with the bullet portions 80', 82' by an integral pair of diametrically opposed, longitudinal ears 114 at the back end of each bullet portion. The maximum diameter of the universal joint is not greater than and preferably less than the maximum diameter of the bullet portions 80', 82' so that the universal joint 112 does not hinder or interfere with the bullet assembly 40' passing through the passage 36' of the hinge roller assembly 30'. Besides economy of manufacture, the Cardan universal joint also provides the space or groove 52' between the bullet portions 80', 82' for receiving a head of the spring loaded pin 50'. That is, the bottom of the circumferential groove 52' is defined by the maximum outer diameter of the universal joint 112 which is less than the maximum outer diameter of both the forward and rearward bullet portions 80', 82'. While a Cardan universal joint is preferred, any suitable universal joint may be used interconnected between ing the forward.

Although the preferred embodiments of the present invention have been disclosed, various changes and modifications can be made thereto by one skilled in the art without departing from the scope and spirit of the invention as set forth in the appended claims. For instance, the pivot arms 71 of the pin engagement device 62 may be disposed above the frame of the hinge roller assembly 30 instead of below. The perpendicular member 67 is then no longer required. In addition, the spring 66 may also be disposed beneath the hinge roller assembly 30 concentrically about the exterior surface of the pin 50 which could project outward from the side of the pivot arm 71 which faces opposite the side toward the bullet assembly 40. Even further, the elongated bullet 40 can potentially be replaced with a sphere shaped bullet and still perform the same function as the elongated bullet. Regardless, it is also understood that the terms used here are rather descriptive and various changes may be made without departing from the scope and spirit of the invention.

What is claimed is:

1. A manual release mechanism for a power operated door having a hinge assembly attached to the door which is pulled along a track in one direction by an elongated flexible member to open the door and pulled in an opposite direction along the track by the elongated flexible member to close the door, the mechanism comprising:

the hinge assembly having a passage extending through the assembly in a generally horizontal direction;

a spring loaded pin mounted on the hinge assembly so as to protrude into the passage in a rest position;

an operator attached to the spring loaded pin to retract the spring loaded pin to a disengaged position where the spring loaded pin does not protrude into the passage; and a bullet assembly attached to the elongated flexible member, the bullet assembly having a space, a forward portion being generally bullet shaped and a rearward portion being generally bullet shaped, the forward and rearward bullet portions being oriented back-to-back, the forward bullet portion having a forward nose, the rearward bullet portion having a rearward nose, the forward and rearward noses pointing away from each other in opposite directions, the space disposed axially between the forward and rearward noses, the pin projecting into the space when the spring loaded pin is in the rest position and the bullet assembly is disposed in the passage of the hinge assembly, and a pin engagement device supported by the hinge assembly, the pin engagement device having the pin, the spring, a pivot arm, a stationary surface and a moving surface, the pivot arm having a pivot end engaged pivotally to the hinge assembly and a distal end engaged rigidly to the pin, the pin disposed generally transversely to the arm, the moving surface disposed on the pivot arm near the distal end and facing away from the pin, the stationary surface facing the moving surface and defined by the hinge assembly, the spring disposed compressibly between the stationary and moving surfaces so that the spring is compressed when the pin is in the disengaged position.

2. The manual release mechanism as set forth in claim 1 wherein the operator has a pivoting lever and a cable, the cable constructed and arranged between the operator and the distal end of the pivot arm.

3. The manual release mechanism as set forth in claim 2 wherein the bullet assembly has a universal joint connecting the forward bullet portion to the rearward bullet portion, and wherein the universal joint has a maximum outer diameter that is no greater than a maximum outer diameter of each of the forward and rearward bullet portions.

4. The manual release mechanism as set forth in claim 3 wherein the elongated flexible member comprises cables.

5. The manual release mechanism as set forth in claim 4 wherein the space is a continuous groove having a bottom defined by a circumferential outer surface of the universal joint.

6. The manual release mechanism as defined in claim 5 wherein the universal joint is a Cardan universal joint.

7. The manual release mechanism as defined in claim 6 wherein each of the forward and rearward bullet portions has a pair of diametrically opposed ears that form part of the Cardan universal joint.

8. A manual release mechanism for a power operated door having a hinge assembly attached to the door which is pulled along a track in one direction by an elongated flexible member to open the door and pulled in an opposite direction along the track by the elongated flexible member to close the door, the mechanism comprising:

the hinge assembly having a passage extending through the assembly in a generally horizontal direction;

a spring loaded pin mounted on the hinge assembly so as to protrude into the passage in a rest position;

an operator attached to the spring loaded pin to retract the spring loaded pin to a disengaged position where the spring loaded pin does not protrude into the passage; and a bullet assembly attached to the elongated flexible member, the bullet assembly having a space, a forward portion being generally bullet shaped and a rearward portion being generally bullet shaped, the forward and rearward bullet portions being oriented back-to-back, the forward bullet portion having a forward nose, the rearward bullet portion having a rearward nose, the forward and rearward noses pointing away from each other in opposite directions, the space disposed axially between the forward and rearward noses, the pin projecting into the space when the spring is in the rest position and the bullet assembly is disposed in the passage of the hinge assembly, and the forward nose having a forward slot bisecting the forward nose longitudinally;

the rearward nose having a rearward slot bisecting the rearward nose longitudinally, the forward and rearward slots generally lying along a plane;

the elongated flexible member having a pull end disposed within the forward slot, the pull end having a traverse member traversing the forward slot and engaged pivotally to the forward nose; and the elongated flexible member having a second pull end disposed within the rearward slot, the second pull end having a traverse member traversing the rearward slot and engaged pivotally to the rearward nose.

9. The manual release mechanism as set forth in claim 8 further comprising:

the bullet assembly having a longitudinal first part and a longitudinal second part, the first part having a planar face and the second part having an opposing planar face engaged to the planar face;

a fastener constructed and arranged to engage the first and second parts together, the fastener extended perpendicularly through the planar and opposing planar faces; and the first and second parts each having concentrically aligned forward and rearward bores which communicate traversely to the respective forward and rearward slots, the forward and rearward traverse members disposed pivotally within the forward bores and rearward bores, respectively.

10. The manual release mechanism as set forth in claim 9 wherein the elongated flexible member comprises elongated bands each having sides disposed perpendicular to the planar face and opposing planar face.

11. The manual release mechanism as set forth in claim 9 wherein the elongated flexible member comprises.

12. The manual release mechanism as set forth in claim 11 wherein the space is a continuous circumferential groove.

13. A manual release mechanism for a power operated door having a hinge assembly attached to the door which is pulled in one direction along a track by an elongated flexible rearward member to open the door and pulled in an opposite direction along the track by an elongated flexible forward member to close the door, the mechanism comprising:

the hinge assembly having a passage extending through the hinge assembly in a generally horizontal direction;

a spring loaded pin mounted on the hinge assembly so as to protrude into the passage in a rest position, the pin being biased into the rest position by the spring;

an operator attached to the spring loaded pin to retract the spring loaded pin to a disengaged position where the spring loaded pin does not protrude into the passage;

a traverse member disposed at an end of the elongated flexible forward member;

a traverse member disposed at an end of the elongated flexible rearward member; and a bullet assembly interconnecting the ends of the forward and rearward flexible members, the bullet assembly having:

a space, a forward portion being generally bullet shaped and a rearward portion being generally bullet shaped, the forward and rearward bullet portions being engaged unitarily back-to-back, the forward bullet portion having a forward nose, the rearward bullet portion having a rearward nose, the forward and rearward noses pointing away from each other in opposite directions, the space disposed axially between the forward and rearward noses, the pin projecting into the space when the spring loaded pin is in the rest position and the bullet assembly is centered in the passage of the hinge assembly, the forward nose bisected longitudinally by a forward slot, the rearward nose bisected longitudinally by a rearward slot, the forward and rearward slots generally lying along a plane, a longitudinal first part having a planar face disposed axially between and planar to the forward and rearward slots and, a longitudinal second part having an opposing planar face engaged to the planar face of the first part, a fastener constructed and arranged to engage the first and second parts together, the fastener extended perpendicularly through the planar and opposing planar faces, and forward and rearward bores which communicate traversely to the forward and rearward slots respectively, the forward and rearward traverse members disposed pivotally within the forward and rearward bores, respectively.

14. The manual release mechanism as set forth in claim 13 further comprising a pin engagement device supported by the hinge assembly, the pin engagement device having the pin, the spring, a pivot arm, a stationary surface and a moving surface, the pivot arm having a pivot end engaged pivotally to the hinge assembly and a distal end engaged rigidly to the pin, the pin disposed generally transversely to the arm, the moving surface disposed on the pivot arm near the distal end and facing away from the pin, the stationary surface facing the moving surface and defined by the hinge assembly, the spring disposed compressibly between the stationary and moving surfaces so that the spring is compressed when the pin is in the disengaged position.

* * * * *